US009257801B2

(12) United States Patent
Fang et al.

(10) Patent No.: US 9,257,801 B2
(45) Date of Patent: Feb. 9, 2016

(54) ELECTRICAL CONNECTOR WITH SHIELDING PLATE

(71) Applicant: FOXCONN INTERCONNECT TECHNOLOGY LIMITED, Grand Cayman (KY)

(72) Inventors: Ai-Hong Fang, Kunshan (CN); Huo-Xing Jin, NanChang (CN); Chun-Sheng Li, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/531,978

(22) Filed: Nov. 3, 2014

(65) Prior Publication Data

US 2015/0126068 A1 May 7, 2015

(30) Foreign Application Priority Data

Nov. 1, 2013 (CN) ..... 2013 2 0682317 U

(51) Int. Cl.

| | |
|---|---|
| ***H01R 13/648*** | (2006.01) |
| ***H01R 24/60*** | (2011.01) |
| ***H01R 43/20*** | (2006.01) |
| ***H01R 13/6587*** | (2011.01) |
| *H01R 107/00* | (2006.01) |

(52) U.S. Cl.

CPC ..... *H01R 24/60* (2013.01); *H01R 13/6587* (2013.01); *H01R 43/20* (2013.01); *H01R 2107/00* (2013.01)

(58) Field of Classification Search

CPC .... H01R 24/60; H01R 24/6587; H01R 43/20; H01R 13/65802; H01R 12/57; H01R 9/032; H01R 13/405; H01R 13/406

USPC ..... 439/607.23

See application file for complete search history.

(56) References Cited

U.S. PATENT DOCUMENTS

| | | | | |
|---|---|---|---|---|
| 8,202,120 | B2 * | 6/2012 | Ko | H01R 12/57 439/607.35 |
| 9,022,802 | B2 * | 5/2015 | Jiang | H01R 13/405 439/541.5 |
| 9,124,008 | B2 * | 9/2015 | Higgy | H01R 9/032 |
| 2009/0170372 | A1 * | 7/2009 | Wang | H01R 12/57 439/607.23 |
| 2009/0286424 | A1 * | 11/2009 | Wang | H01R 27/02 439/607.23 |
| 2010/0112862 | A1 * | 5/2010 | Chiu | H01R 13/65802 439/607.23 |

FOREIGN PATENT DOCUMENTS

| | | |
|---|---|---|
| TW | M387405 | 8/2010 |

* cited by examiner

*Primary Examiner* — Jean F Duverne

(74) *Attorney, Agent, or Firm* — Wei Te Chung; Ming Chieh Chang

(57) ABSTRACT

An electrical connector has a conductive shell, a terminal module and a shielding plate. The conductive shell has a mating portion and an accommodate room. The mating portion has a first mating face. The terminal module is secured in the accommodate room and has a first insulator and a plurality of first terminals. The first insulator has a first face and a second face. Each of the first terminals has a first contacting portion protruding out of the first face of the first insulator. The shielding plate is disposed in the accommodate room and contacts with the conductive shell. The shielding plate presses on the second face of the first insulator so as to make first contacting portions be exposed to the first mating face. The disposition of the shielding plate has the function of pressing on the terminal module and preventing the interference of signal transmission between the terminals.

14 Claims, 7 Drawing Sheets

ELECTRICAL CONNECTOR WITH SHIELDING PLATE

BACKGROUND OF THE INVENTION

1. Field of the Invention

The present invention generally relates to an electrical connector, and more particularly to an electrical connector with a shielding plate secured therein.

2. Description of Related Art

TW patent No. M387405 discloses an electrical connector comprising a first terminal module embedded with a plurality of first terminals, a second terminal module embedded with a plurality of second terminals, a front insulator, a metal shell and a grounding plate. The grounding plate is sandwiched between the first and the second terminal modules. The front insulator defines an accommodate room from a rear end portion thereof into which the first and second terminal modules and the grounding plate are assembled together. The grounding plate has one engagement portion at each of the sides thereof. The grounding plate protrudes out of the first and second terminal modules and contacts with the metal shell. With the development of the electrical connector, a new docking connector with a conductive shell made by powder metallurgy technology is designed. In the manufacturing process of the electrical connector, the terminal modules and the shielding plate are assembled into the conductive shell one after another, and then are injected with plastic material. It means that the precision of the assembly needs higher requirement.

In view of the foregoing, an electrical connector with a shielding plate coupled therein is able to resolve the problem described aforementioned would be desirable.

SUMMARY OF THE INVENTION

Accordingly, an object of the present invention is to provide an electrical connector, the electrical connector has a good shielding effect and simple assembly.

In order to achieve the object set forth, an electrical connector includes a conductive shell, a terminal module received in the conductive shell and a shielding plate. The conductive shell has a mating portion extending forwardly and an accommodate room recessed from the rear end thereof. The mating portion has a first mating face. The terminal module is secured in the accommodate room and has a first insulator and a plurality of first terminals retained in the first insulator. The first insulator has a first face and a second face opposite to the first face. Each of the first terminals has a first contacting portion protruding out of the first face of the first insulator. The shielding plate is disposed in the accommodate room and contacts with the conductive shell. The shielding plate presses on the second face of the first insulator so as to make first contacting portions of the first terminals be exposed to the first mating face.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
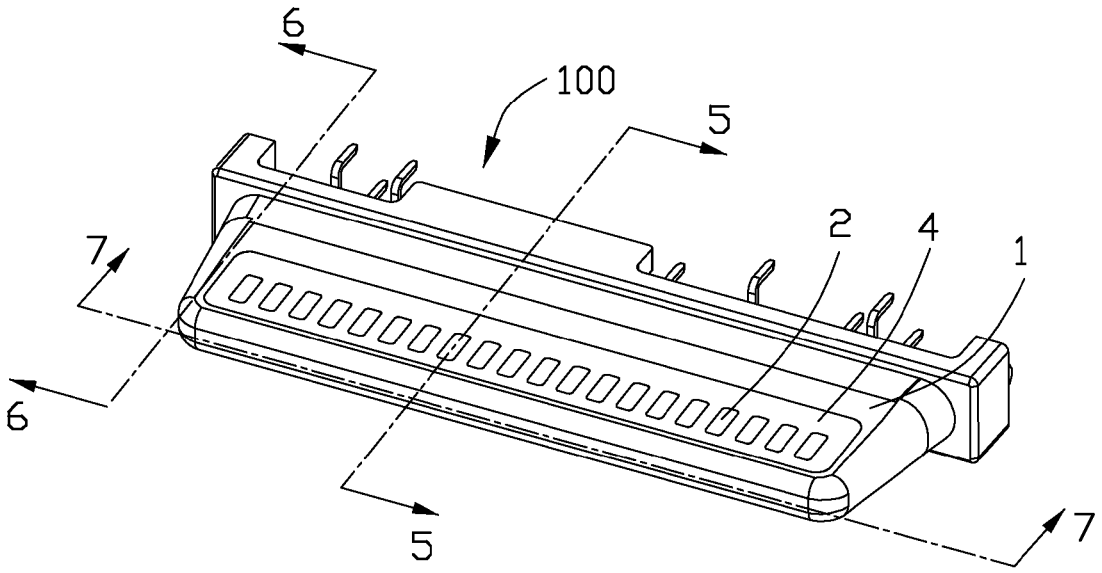
FIG. 1 is a perspective view of an electrical connector of the present invention.
Figure 2:
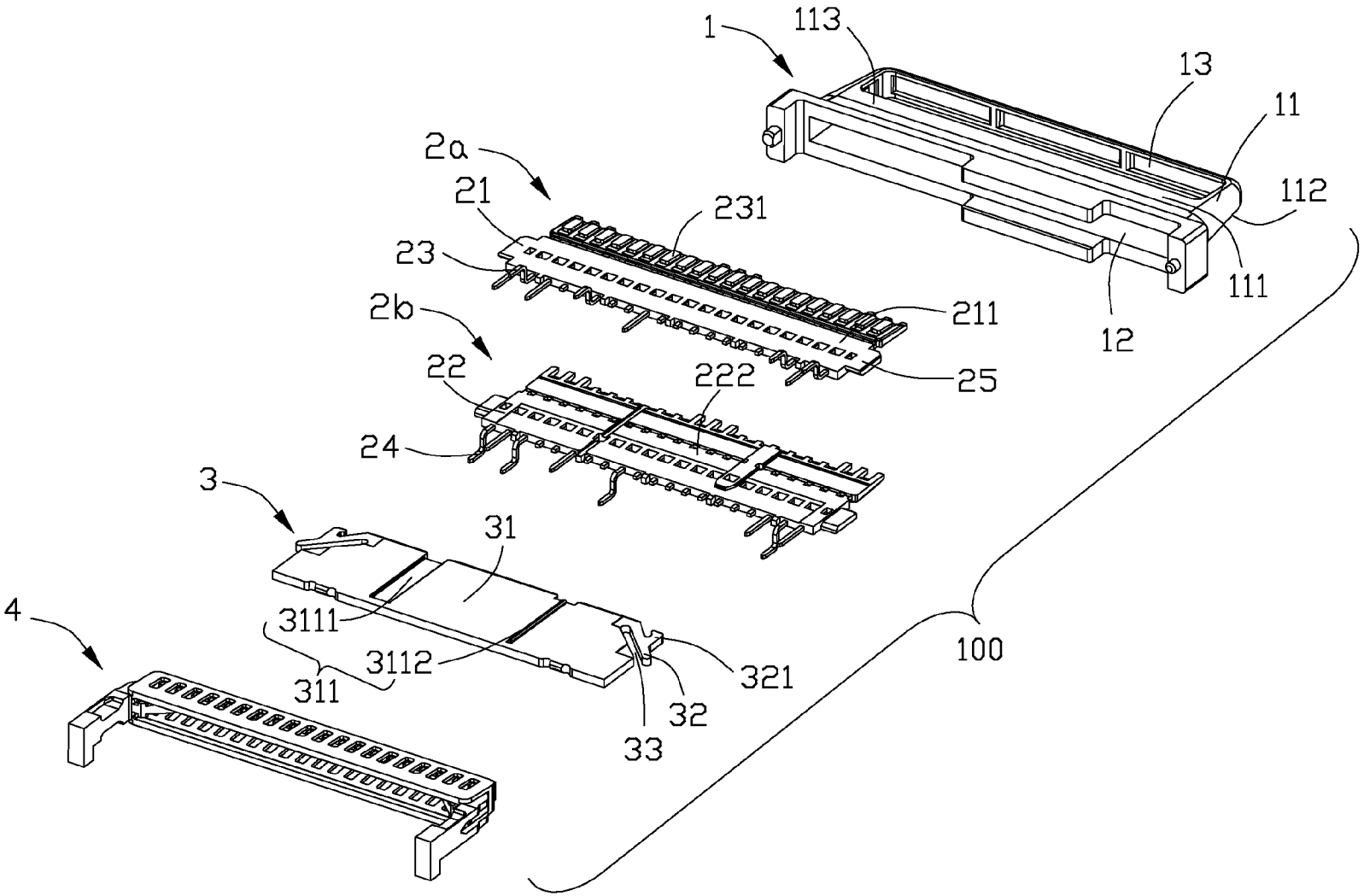
FIG. 2 is an exploded perspective view of the electrical connector in FIG. 1.

Referring to FIG. 1 and FIG. 2, the present invention provides an electrical connector 100 comprising a conductive shell 1, a terminal module 2 secured within the conductive shell 1 and a shielding plate 3. The conductive shell 1 has a mating portion 11 extending forwardly and an accommodate room 12 recessed from a rear end face thereof. The mating portion 11 is configured as symmetric structure and has a first mating face 111 and a second mating face 112 opposite to the first mating face 111. The mating portion 11 has a base portion 113 and two opposite end walls which connect with the first and second mating faces 111, 112 and are formed with the two mating faces 111, 112 in one process. The mating portion 11 extends forwardly from the base portion 113 and is configured as tapered with the width thereof along a longitudinal direction decreases from the rear to front orientation. The terminal module 2 is secured in the accommodate room 12. The shielding plate 3 is positioned in the accommodate room 12 and contacts with the conductive shell 1. The conductive shell 1 is made by the technology of powder metallurgy. The shielding plate 3 is used for pressing on the terminal module 2 after the terminal module 2 and the shielding plate 3 are assembled into the conductive shell 1 one after another.

Figure 3:
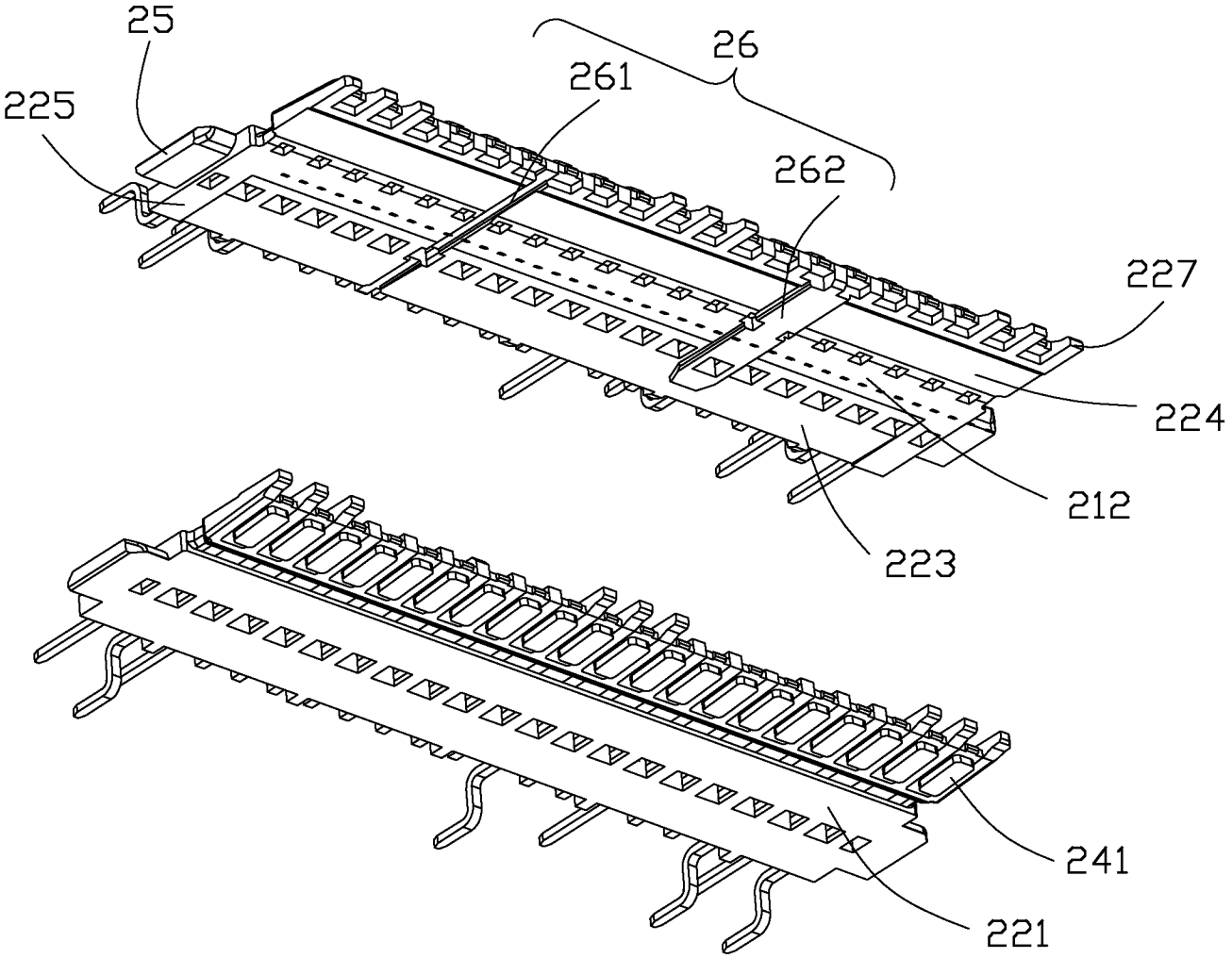
FIG. 3 is a perspective view of a first terminal module and a second terminal module of the electrical connector in FIG. 2.

Referring to FIG. 2 and FIG. 3, The terminal module 2 aforementioned comprises a first terminal module 2*a* with a first insulator 21 and a plurality of first terminals 23 coupled in the first insulator 21 and a second terminal module 2*b* with a second insulator 22 and a plurality of second terminals 24 coupled in the second insulator 22. The first insulator 21 has a first face 211 and a second face 212 opposite to the first face 211. Each of the first terminals 23 has a first contacting portion 231 protruding out of the first face 211 of the first insulator 21. The shielding plate 3 upwardly presses on the second face 212 of the first insulator 21 so as to make the first contacting portions 231 of the first terminals 23 be exposed in the first mating face 111 aforementioned. The second terminal module 2*b* roughly has a same structure with the first terminal module 2*a*. The second insulator 22 has a third face 221 and a fourth face 222 opposite to the third face 221. Each of the second terminals 24 has a second contacting portion 241 protruding out of the third face 221 of the second insulator 22. The shielding plate 3 is sandwiched between the first terminals 23 and the second terminals 24 and downwardly presses on the fourth face 222 of the second insulator 22 so as to make the second contacting portions 24 of the second terminals 24 be exposed in the second mating face 112 aforementioned. The second and fourth faces 212, 222 of the two terminal modules 2*a*, 2*b* have a same structure and are directly face to face in the accommodate room 12 before the shielding plate 3 is assembled in. The first and third faces 211, 221 of the two terminal modules 2*a*, 2*b* have a same structure and face to an outer side.

The second and fourth faces 212, 222 of the first and second insulators 21, 22 will be described in detail hereinafter. The same structures or components will be labeled with a same mark. The second and fourth faces 212, 222 both have a first hollow portion 223 near a rear end thereof and a second hollow portion 224 near the first and second contacting portions 231, 241. The first and second hollow portions 223, 224 of the second and fourth faces 212, 222 extend along a longitudinal direction, and the second hollow portions 224 respectively run through two side edges of the second face 212 and the fourth face 222. The first hollow portions 223 run through the rear end of the first and second terminal modules 2*a*, 2*b*. Conjoined to FIG. 5, after the assembly of the two terminal modules 2*a*, 2*b*, there are two gaps between the shielding plate 3 and the insulators 21, 22 of the two terminal modules 2*a*, 2*b*. The two gaps will provide two buffer zones when the moulds press on the two terminal modules 2*a*, 2*b* with the plastic material 4 being injected into to the assembling modules.

The remaining part apart from the first and second hollow portions 223, 224 of the second face 212 and the fourth face 222 form supporting faces 225 used for pressing on the shielding plate 3. The second and the fourth faces 212, 222 separately define a plurality of ribs 227 between every two first contacting portions 231 and every two second contacting portions 241, thereby these ribs 227 are located between every two first terminals 23 and every two second terminals 24. Combined to FIG. 7, some of the ribs 227 aforementioned are longer than the other ribs 227 and adjacent to the front inner surface of the conductive shell 1. These longer ribs 227 are benefit for resisting the force formed by the injection of the plastic material 4.

Figure 5:
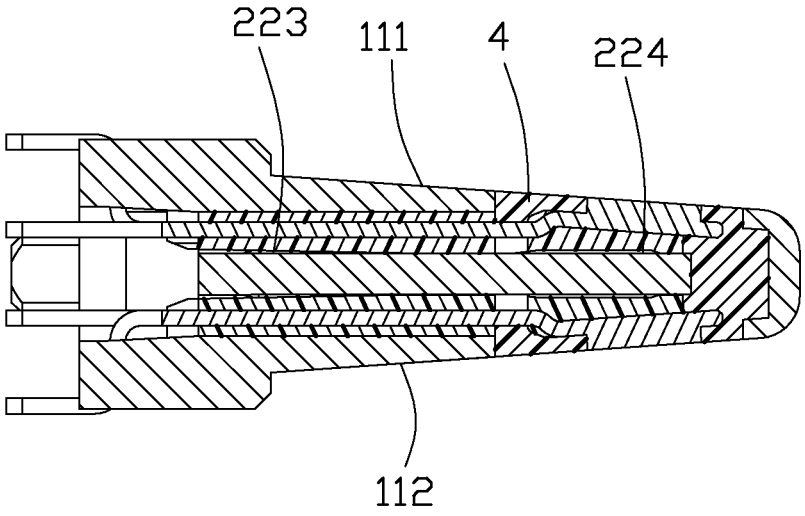
FIG. 5 is a sectional perspective view of the electrical connector along line 5-5 in FIG. 1.
Figure 7:
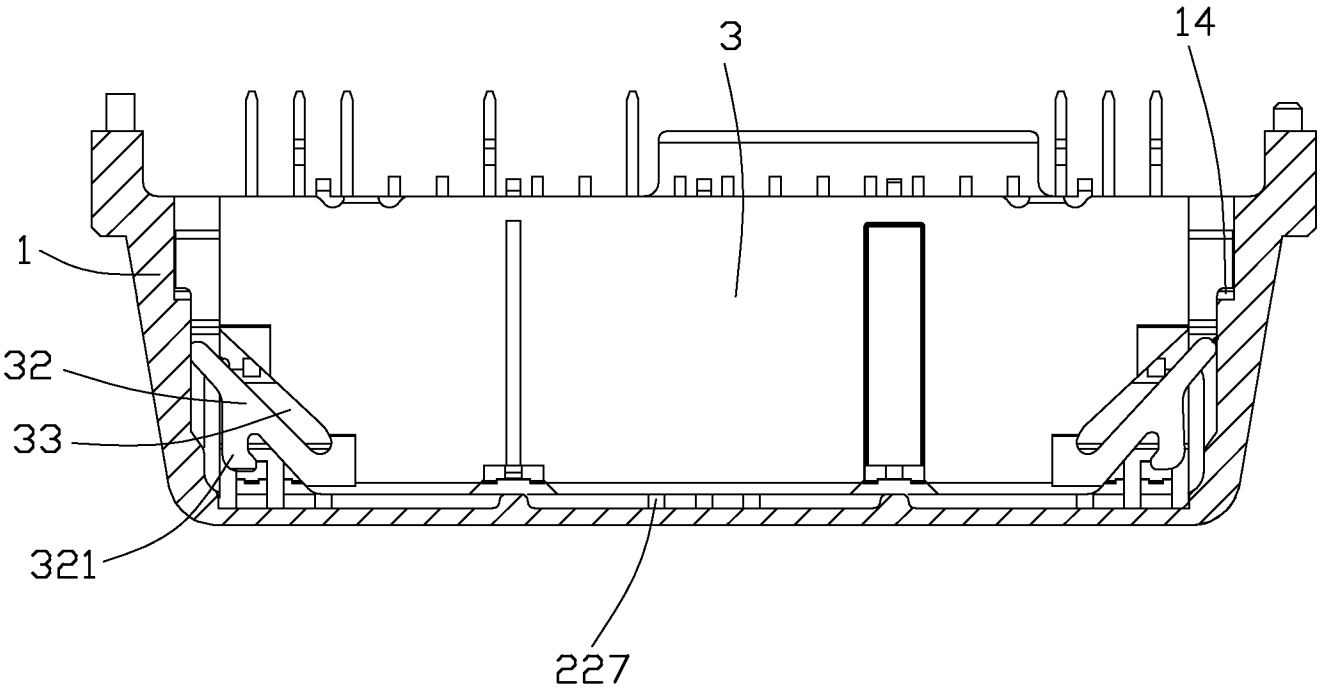
FIG. 7 is a sectional perspective view of the electrical connector along line 7-7 in FIG. 1.

In the present embodiment, the shielding plate 3 has a shielding section 31 with the front region being thinner than the rear region thereof. The shielding plate 3 defines two elastic arms 32 extending outwardly and near the front end of two sides of the shielding section 31. The two elastic arms 32 separately contacts with the conductive shell 1 after the shielding plate 3 is assembled, and two hollow slots 33 are provided between the elastic arms 32 and the shielding section 31. The hollow slots 33 are provided for giving way to the process of assembling the shielding plate 3 into the accommodate room 12. Each of the elastic arms 32 has a hook-like protruding portion 321 extending forwardly therefrom. As illustrated in FIG. 5 and FIG. 7, the front end of the protruding portion 321 is hooked inwardly and is located between the first and second insulators 21, 22.

What's more, the shielding plate 3 defines a first limiting part 311 extending forwardly on each of two opposite surfaces thereof, and each of the second and fourth faces 212, 222 of the first and second insulators 21, 22 defines a second limiting part 26 corresponding to the first limiting part 311. In the present embodiment, the first limiting part 311 comprises a first inserting slot 3111 recessed from one surface of the shielding plate 3 and a first inserting rib 3112 protruding outwardly from the same surface as described aforementioned, they are disposed side by side. The two first inserting slot 3111 and the two inserting ribs 3112 are separately configured as center symmetric. The first inserting slots 3111 extend forwardly and run through the front side edge of the two surfaces of the shielding plate 3, and the first inserting ribs 3112 extend forwardly to the front side edge of the two surfaces of the shielding plate 3. Of course, in other embodiments, the first and second limiting parts 311, 26 also can be disposed in other ways, for example, the first limiting part 311 comprises two inserting slots at each surfaces of the shielding plate 3, and the two terminal modules 2*a*, 2*b* define the inserting ribs corresponding to the inserting slots aforementioned. The disposition of the shielding plate 3 and the first and second terminal modules 2*a*, 2*b* can make the two terminal modules 2*a*, 2*b* secured well in the accommodate room 12, thereby preventing these components from offsetting from each other in the process of injecting the plastic material. Conjoint to FIG. 7, the elastic arms 32 and the hollow slots 33 ensure that the shielding plate 3 moves along the inner side of the conductive shell 1 with zero force between them. The plastic material will flow into the hollow slots 33 so as to better retain the terminal modules 2*a*, 2*b*.

Figure 4:
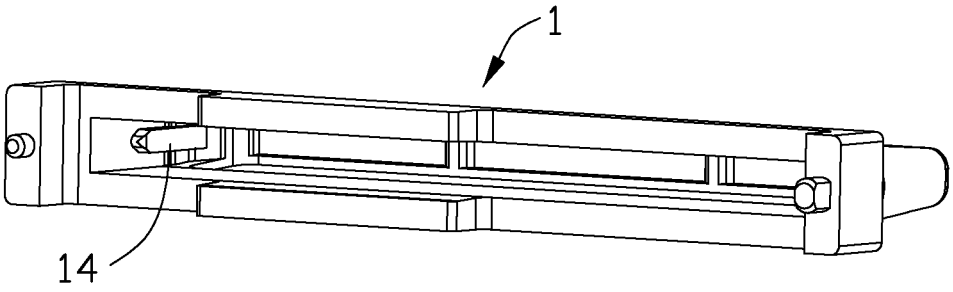
FIG. 4 is a perspective view of a conductive shell of the electrical connector in FIG. 1.
Figure 6:
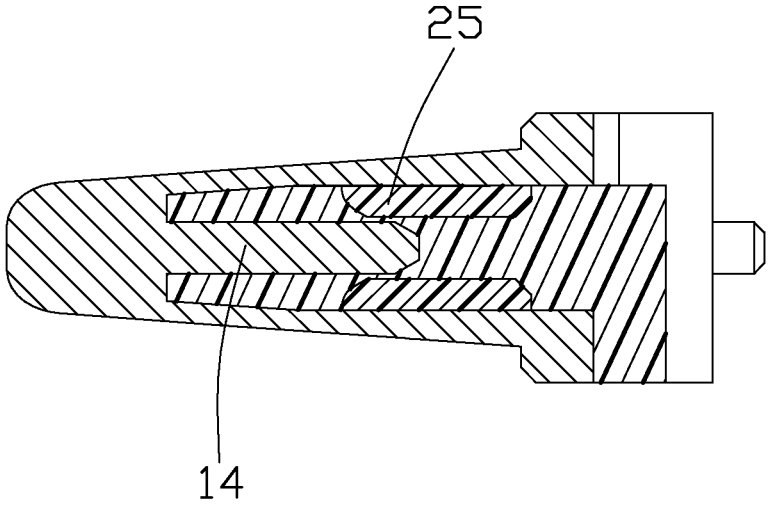
FIG. 6 is a sectional perspective view of the electrical connector along line 6-6 in FIG. 1.

Referring to FIG. 4 and FIG. 6, the conductive shell 1 has an inner surface facing to the accommodate room 12 and two guiding post 14 extending rearwards and horizontally from the inner surface of the accommodate room 12 and is located in the accommodate room 12. The first and second insulators 21, 22 each has two guiding blocks 25 at two sides thereof corresponding to the guiding posts 14. After the two terminal modules 2*a*, 2*b* are assembled into the accommodate room 12, the two terminal modules 2*a*, 2*b* are separately positioned at two sides (upper side and lower side) of the two guiding posts 14, correspondingly, the two guiding posts 14 are separately located between one guiding block 25 of the first insulator 21 and another guiding block 25 of the second insulator 22. As illustrated in FIG. 7, the shielding plate 3 is assembled into the accommodate room 12 and located between two guiding posts 14 and the elastic arms 32 contacts with the conductive shell 1.

When finishing the assembling of the components aforementioned, the plastic material 4 will be injected into the corresponding rooms. At least one opening 13 is formed at the first and second mating faces 112 of the mating portion 11 which is communicating with the accommodate room 12. The terminal module 2 is adjacent to the inner surface of the mating portion 11. When the first and second terminal modules 2*a*, 2*b* are assembled into the accommodate room 12, the first and second contacting portions 231, 241 of the first and second terminals 23, 24 are separately exposed to the openings 13 with the plastic material 4 filled in the opening 13. Conjoint to FIG. 5, the plastic material 4 seals the terminal modules 2*a*, 2*b* so as to make the plastic material 4 and the first mating face 111 are in a same plane in one side, and the plastic material 4 and the second mating face 112 are in another same plane in the other side.

In conclusion, the shielding plate 3 is disposed in the accommodate room 12 and contacts with the conductive shell 1, and is also sandwiched by the terminal module 2, thereby is benefit to prevent the interference of the signal transmission between the two rows of the terminals 23, 24.

It is to be understood, however, that even though numerous characteristics and advantages of the present invention have been set forth in the foregoing description, together with details of the structure and function of the invention, the disclosure is illustrated only, and changes may be made in detail, especially in matters of shape, size, and arrangement of parts within the principles of the invention to the full extent indicated by the broad general meaning of the terms in which the appended claims are expressed.

We claim:

1. An electrical connector comprising:

a conductive shell, the conductive shell having a mating portion extending forwardly and an accommodate room recessed from a rear end thereof, the mating portion defining a first mating face;

a terminal module, the terminal module secured in the accommodate room and comprising a first insulator and a plurality of first terminals retained in the first insulator, the first insulator having a first face and a second face opposite to the first face, the first terminals having first contacting portions protruding out of the first face of the first insulator; and a shielding plate;

wherein the shielding plate is located within the accommodate room and contacts with the conductive shell, and the shielding plate upwardly presses on the second face of the first insulator so as to make the first contacting portions of the first terminals be exposed to the first mating face; wherein the shielding plate has a shielding section with a front region thereof is thinner than a rear region thereof and is located between the first and second terminals, the shielding plate has two elastic arms extending outwardly from two sides thereof, and the elastic arms contact with the conductive shell; wherein the elastic arm extends rearwards and at an inclined angle, and two hollow slots are formed between the elastic arms and the shielding section; wherein the shielding plate has two opposite surfaces each of which is separately provided with a first limiting part, and each of the first and second insulators has a second limiting part on the second and fourth faces thereof corresponding to the first limiting parts; wherein each of the first limiting parts comprises a first inserting slot and a first inserting rib, each of the second limiting parts in the second and the fourth faces has a second inserting rib and a second inserting slot corresponding to the first limiting parts.

2. The electrical connector as claimed in claim 1, wherein the elastic arm extends rearwards and at an inclined angle, and two hollow slots are formed between the elastic arms and the shielding section.

3. The electrical connector as claimed in claim 2, wherein each of the elastic arms has a hook-liked protruding portion extending forwardly therefrom, the front section of the protruding portion is positioned between the first and second insulators.

4. The electrical connector as claimed in claim 1, wherein the second face of the first insulator defines a first hollow portion running through a rear end edge thereof and a second hollow portion which is in front of the first hollow portion and runs through two sides thereof, and the rest parts apart from the first and second hollow portions of the second face commonly form a supporting face for the shielding plate.

5. The electrical connector as claimed in claim 1, wherein each of the first and second mating faces has an opening communicating with the accommodate room, the terminal modules are adjacent to the inner surface of the mating portion, the first and second contacting portions of the first and second terminals protrude into the two openings which are filled with plastic material after the terminal modules are assembled in, and the plastic material seals the terminal modules so as to make the plastic material with the outer surface be parallel to the first and second mating faces of the mating portion.

6. The electrical connector as claimed in claim 1, wherein the conductive shell has an inner surface facing to the accommodate room and two guiding posts extending rearwards and horizontally from the inner surface to be exposed in the accommodate room, the first and second insulators both have guiding blocks corresponding to the guiding posts, the two guiding posts are separately between two guiding blocks of the first and second insulators.

7. A method of making an electrical connector, comprising steps of:

providing a metallic shell defining a mating tongue with opposite first and second mating faces and an accommodating room communicating with an exterior through said opposite first and second mating faces in a vertical direction and through a rear face of the shell in a front-to-back direction perpendicular to said vertical direction;

providing a terminal module with a first insulator having a plurality of first terminals thereon and a second insulator having a plurality of second terminals thereon;

inserting said terminal module forwardly into the accommodating room from said rear face in said front-to-back direction; and inserting a middle piece into a space between said first insulator and said second insulator to push the first insulator and the second insulator away from each other in said vertical direction to have the first terminals and the second terminals exposed upon the corresponding first mating face and second mating face in essentially a flush manner; further injecting plastic material into space between the shell and the terminal module and filling said space so as to bind the terminal module within the shell.

8. The method as claimed in claim 7, wherein said middle piece is a metallic shielding plate.

9. The method as claimed in claim 8, wherein said shielding plate is mechanically and electrically connected to the shell.

10. The method as claimed in claim 7, wherein the first terminals are insert-molded with the first insulator, and the second terminals are insert-molded with the second insulator.

11. An electrical connector comprising:

a metallic shell defining a mating tongue with opposite first and second mating faces and an accommodating room communicating with an exterior through said opposite first and second mating faces in a vertical direction and through an opening in a rear face of the shell in a front-to-back direction perpendicular to said vertical direction;

a terminal module with a first insulator having a plurality of first terminals thereon and a second insulator having a plurality of second terminals thereon;

said opening being configured and dimensioned to allow said terminal module to be forwardly into the accommodating room from said rear face in said front-to-back direction when said first insulator and said second insulator are intimately close to each other in the vertical direction; and a middle piece inserted into a space between said first insulator and said second insulator to push the first insulator and the second insulator away from each other in said vertical direction after said terminal module is inserted into the space so as to have the first terminals and the second terminals exposed upon the corresponding first mating face and second mating face in essentially a flush manner; further injecting plastic material into space between the shell and the terminal module and filling said space so as to bind the terminal module within the shell.

12. The electrical connector as claimed in claim 11, wherein said middle piece is a metallic shielding plate.

13. The electrical connector as claimed in claim 12, wherein said shielding plate is mechanically and electrically connected to the shell.

14. The electrical connector as claimed in claim 11, wherein the first terminals are integrally formed with the first insulator, and the second terminals are integrally formed with the second insulator.

* * * * *